US005220133A

United States Patent [19]

Sutherland, Jack E. et al.

[11] Patent Number: 5,220,133

[45] Date of Patent: Jun. 15, 1993

[54] INSULATED CONDUCTOR WITH ARC PROPAGATION RESISTANT PROPERTIES AND METHOD OF MANUFACTURE

[75] Inventors: Sutherland, Jack E.; Donald S. Dombrowsky, both of St. Augustine, Fla.

[73] Assignee: Tensolite Company, St. Augustine, Fla.

[21] Appl. No.: 842,921

[22] Filed: Feb. 27, 1992

[51] Int. Cl.[5] ..... H01B 7/02

[52] U.S. Cl. ..... 174/120 R; 156/53; 156/56; 174/110 N; 174/110 FC; 174/120 SR

[58] Field of Search ..... 174/120 R, 120 SR, 110 FC, 174/110 N, 126.2; 156/52, 53, 56

[56] References Cited

U.S. PATENT DOCUMENTS

| | | | |
|---|---|---|---|
| 3,422,215 | 1/1969 | Humes | 174/120 R |
| 3,488,537 | 1/1970 | Beddows | 174/120 R |
| 4,628,003 | 12/1986 | Katz | 174/120 SR X |
| 4,791,966 | 12/1988 | Eilentropp | 174/110 FC X |
| 4,801,501 | 1/1989 | Harlow | 174/120 SR X |

FOREIGN PATENT DOCUMENTS

| | | | |
|---|---|---|---|
| 2053960 | 5/1972 | Fed. Rep. of Germany | 174/120 SR |
| 9009853 | 9/1990 | PCT Int'l Appl. | 174/120 R |

OTHER PUBLICATIONS

Tensolite Company brochures "TUFFLITE 2000—Advanced Airframe Wire TL and TLT"; TUFFLITE TM 2000—Advanced Airframe Wire TL, TLT & TL Plus.

Report entitled "New Insulation Constructions for Aerospace Wiring Applications"; Soloman, Ron et al; McDonnell Douglas Corp.; Materials Directorate, Wright Laboratories; Air Force Systems Command, Wright-Patterson Air Force Base, Ohio; Jun. 1991.

*Primary Examiner*—Morris H. Nimmo

*Attorney, Agent, or Firm*—Wood, Herron & Evans

[57] ABSTRACT

An insulated conductor having improved arc propagation resistant properties. The insulation consists of a first layer of a composite tape of polyimide between two layers of polytetrafluoroethylene. The second overlaying tape layer is unsintered polytetrafluoroethylene. Further disclosed is a process for manufacturing a sintered wire product having a tin plated electrical conductor.

13 Claims, 2 Drawing Sheets

INSULATED CONDUCTOR WITH ARC PROPAGATION RESISTANT PROPERTIES AND METHOD OF MANUFACTURE

FIELD OF THE INVENTION

The invention relates to an insulated electrical wire product having improved arc propagation resistant properties as well as to a method of manufacturing an electrically insulated conductor having multiple layers of insulation. More specifically, the invention relates to an insulated conductor resistant to the propagation of an electrical arc in aircraft wiring applications, and the method of making an improved electrically insulated conductor.

BACKGROUND OF THE INVENTION

In various wiring installations, specifically in airframe or aircraft applications, the consequence of a fire or explosion resulting from an electrical arc propagation along the wire insulation is particularly serious. The insulation may be broken or damaged, exposing the wire in a number of ways, such as by the rubbing or chafing of the insulation along a sharp edge of the aircraft frame, or, in combat situations by unfriendly gunfire. When the insulation of a voltage-carrying wire is broken, subsequent contact of the exposed wire with another exposed wire or metal airframe member causes a short circuit which creates a large current discharge, generating an arc which melts the copper and decomposes the insulation into a conductive material such as carbon. This arc, in turn, generates sufficient energy to decompose or ablate the insulation of an adjacent wire. Clearly, if the adjoining insulation readily degrades to form conductive carbon paths and expose more wire after being subjected to the arc, the process of short circuiting can continue, increasing both the risk of electrical arcing and burning and/or explosion of flammable components in the vicinity.

There are several tests which measure resistance to arc propagation. Arc propagation resistance is tested under both dry and wet conditions. Dry arc testing is used to determine the ability of an insulation system to resist arc propagation resulting from a short circuit. Wet arc testing serves the function of determining the arc propagation resistance of the insulation system when an exposed conductor is subject to moisture which creates a conductive path. Several standardized tests have been developed to perform dry and wet arc testing, such as the SAE AS 4373 method 301 dry arc resistance and fault propagation and method 509 wet arc tracking, and the Boeing BMS 13—60 arc resistance. These test procedures are incorporated herein by reference.

Testing is typically performed on stranded copper wire having a metal coating which serves to protect the copper from oxidation, thereby improving solderability. If the insulated conductor is to have a 150° C. rating, a coating of high purity tin, typically applied by electroplating, is used as the coating metal for the conductor. If the insulated conductor is to be rated for temperatures up to 200° C., silver is used, and for ratings up to 260° C., a nickel coating is used. Though the metal coating may be applied by dipping or other electroless method, the stranded copper wire is typically electroplated, and therefore will be described throughout as being plated with tin, silver or nickel.

One method of decreasing the risk of arc propagation is to increase the thickness of the insulation so that the arc duration and intensity is diminished. Further, because the distance between the adjacent wires is greater, the likelihood of damaging adjacent wires is decreased.

When the thickness of the insulation is increased, the insulation volume and weight typically also increase. Particularly in aircraft applications, but also for other uses of the insulated conductors where overall component weight and volume is critical, even small increases in volume or weight cannot be tolerated. Thus, the insulation must both protect against arc propagation and be of as low weight and dimension as possible.

One material having utility in improving the arc propagation resistance of the wire insulation is polytetrafluoroethylene (PTFE). PTFE is either applied to a wire as a tape which is wrapped on a bias with a certain degree of overlap, or as an extrusion, or as a coating over the wire. In either case, the PTFE is applied in the uncured, or unsintered, state. After the application, the PTFE is then sintered by application of heat.

During the sintering of the PTFE, the temperature of the environment during sintering must be greater than about 720° F. (382° C.). At these temperatures, the silver (200° C. rating) and nickel (260° C. rating) metal plating on the copper strand is not affected. However, tin (150° C. rating) plating on the copper is affected in one of the following ways by high processing temperatures. Tin is the least expensive of the three metal coatings, but it melts at the relatively low temperature of about 232° C. The tin plating will oxidize under the temperatures needed to sinter PTFE. This oxidation renders the surface resistant to soldering. Further, excess tin coating on the surface of the copper strand may melt and bond to adjacent strands. Finally, the processing temperature may be even sufficient to cause the tin to fully alloy with a portion of the copper strand, which also renders the wire resistant to soldering. The risk of temperature-related degradation is particularly acute where the insulation provides little heat protection, as where the diameter is small or the weight low, as required in aircraft applications.

Thus, one problem in insulated wire manufacture is the inability to use an unsintered PTFE layer over a tin-plated conductor, such as copper strand, where the temperature necessary for further processing of the PTFE layer heats the tin-plated conductor to temperatures sufficient to degrade the tin plating. There also remains the continuing problem of providing an arc propagation resistant insulated conductor having an insulation layer of minimized weight and diameter.

Therefore, one object of the invention is to provide an insulated conductor having a sintered PTFE outer layer where the conductor, such as copper strand, is plated with tin.

Another object is to provide an insulated conductor which is both arc propagation resistant and able to be used in applications requiring physical toughness together with minimum diameter and weight.

Yet another object of the invention is to provide a process for manufacturing arc propagation resistant tin-plated conductor having an arc propagation resistant insulation containing PTFE whereby the PTFE outer layer is sintered without degrading the tin coating on the conductor.

SUMMARY OF THE INVENTION

The invention is directed to an insulated electrical conductor with arc propagation resistant properties comprised of an electrical conductor, typically copper strand, covered with a first tape layer of a composite of polyimide between two layers of polytetrafluoroethylene (PTFE), with a second overlying tape layer comprised of unsintered PTFE. These two layers of tape are then subjected to elevated temperatures sufficient to sinter the outer layer of PTFE to form an insulated conductor having excellent arc propagation resistant properties. The composite tape is available in a sealable version which, in the presence of the elevated sintering temperatures causes the overlapped tape film in the first layer next to the conductor to bond to itself, thus improving the integrity of the first layer and sealing the electrical conductor inside an essentially continuous coating.

This two-layer tape insulation may be used over a variety of conductors, such as copper strands plated with plated tin, silver, or nickel. However, as noted above, the processing temperatures necessary for sintering the PTFE will raise the temperature of the tin coating sufficiently to cause degradation by one of several pathways. This problem is particularly acute when there are only two layers of tape separating the tin plating from the source of the heat.

It is to address this problem that a novel process has been developed to sinter the outer PTFE layer of the insulated conductor without degrading the tin plating on the wire itself. It has been found that by increasing the temperature in the sintering oven and passing the insulated conductor through the oven at an increased velocity one obtains a sintered conductor without damage to the underlying tin plating. The arc propagation resistance has been further improved by applying the overlapping layers of composite and PTFE tape within a specific range of tape tension. It is believed that wrapping of the tapes within this range improves the integrity of the insulation.

The objects and advantages of the present invention will become readily apparent from the following detailed description of the insulated conductor and the process for making, which description should be considered in conjunction with the accompanying drawings in which:

DETAILED DESCRIPTION OF THE INVENTION

The invention in its broader aspects relates to an insulated electrical conductor having arc propagation resistant properties comprising a conductor of electrical current, a first film overlaying the conductor, this first film comprised of a composite of a polyimide layer between two layers of polytetrafluoroethylene (PTFE), and a second film overlaying the first film comprised of unsintered PTFE.

The arc propagation resistance of an insulated conductor is a function in part of the thickness and integrity of the insulation over the electrical conductor. Thus, where, as here, uniformity of the thickness of the insulation over the length of the conductor is important to obtaining maximum arc propagation resistance, the insulation is formed preferably from multiple layers of tape. Alternatively, the outer PTFE insulation layer may be extruded or applied as a coating over the composite tape layer if the requisite uniform coating can be applied.

Figure 1:
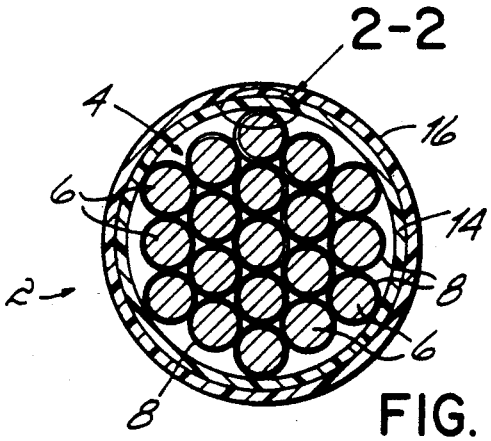
FIG. 1 is a cross-sectional view of the insulated conductor.

Referring to the figures, FIG. 1 shows an insulated conductor 2. This insulated conductor 2 is comprised of an electrical conductor 4, consisting in this instance of stranded copper 6 with a metal plating 8, which for purposes of discussion is tin. Alternatively, silver, nickel or other commonly employed plating metals may be used. The tin plating 8 is applied by electroplating a uniform thickness of high purity tin to the individual wires comprising the strand. Instead of using stranded copper 6, a solid wire may be used with the insulation of the invention. However, the solid wire is not preferred in applications where vibration is a factor, such as in aircraft and outer space vehicles. Other conductive materials may also be used according to the teachings of this invention, including, but not limited to, aluminum, bare copper and copper alloy wire. The tin plate as noted above is a coating which is intended to protect the underlying stranded copper 6 from oxidation effects. Also, when the electrical conductor 4 is soldered to another conductive metal, the tin plating 8 will wet at soldering temperatures to improve the integrity of the electrical connection.

Stranded copper is available in several configurations. The strands may have a unilay construction, wherein successive layers have the same lay direction and lay length. The wire may be constructed with concentric stranding wherein the central core is surrounded by one or more layers of helically wound strands in a fixed round geometric arrangement. Also, the wire may be manufactured with a unidirectional concentric construction, wherein the lay direction of successive layers are the same with increasing lay length. For larger diameters, the wire is formed by bundling individual wire bundles, resulting in a rope strand appearance.

A number of companies manufacture stranded copper conductor with metal electroplating. One such manufacturer is Hudson International Conductors, Ossining, New York. A copper conductor consisting of nineteen strands of 32 AWG (American Wire Gauge) copper individually coated by a tin electroplating is obtainable from Hudson International Conductors as part No. 19-32-601-21. This conductor has a diameter which is the effective equivalent of 20 AWG solid wire.

The electrical conductor 4 in FIG. 1 is coated with two layers of insulation. The first layer adjacent the electrical conductor 4 is a composite tape 14. The outer layer is a PTFE tape 16. The composite tape 14 is comprised of a layer of polyimide between two layers of PTFE, and is shown in more detail in FIG. 2. Alternatively, the composite tape is comprised of a layer of polyimide between two layers of PTFE wherein the PTFE layers can be sealed at temperatures that are lower than sintering temperatures, as shown in more detail in FIG. 3.

Figure 4:
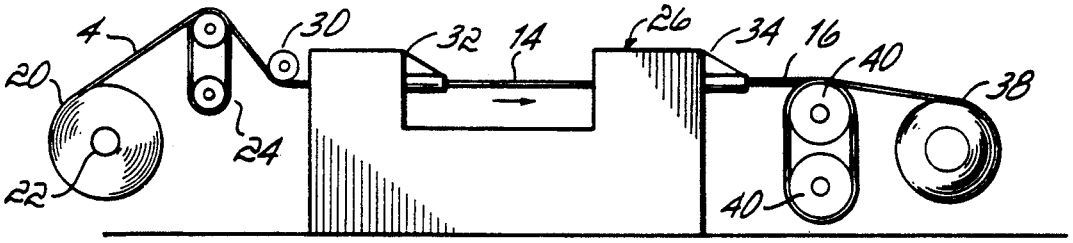
FIG. 4 is a diagramatic view of the apparatus used for applying two layers of tape to an electrical conductor.

The electrical conductor 4 is wrapped by a process well known to those skilled in the art. A two-head taping machine, such as that depicted in the diagram in FIG. 4, is typically employed for the tape wrapping procedure. A spool 20 of electrical conductor 4 is mounted on post 22. Electrical conductor 4 from spool 20 is fed into tape wrapping machine 26 after passing through dancer sheaves 24. The takeoff tension from spool 20 is adjusted by passage of the electrical conductor 4 from spool 20 around dancer sheaves 24 and then under idler wheel 30. Electrical conductor 4 fed into tape wrapping machine 26 passes the first wrapping head 32, where the composite tape 14 is applied to the electrical conductor 4. The conductor 4 with a first layer of composite tape 14 then passes directly to the second wrapping head 34 where the outer unsintered PTFE layer is applied. Both wrapping heads 32 and 34 provide a constant rotating mechanism to wrap tape around the electrical conductor 4.

After exiting the second wrapping head 34, the electrical conductor 4 wrapped with overlapping layers of composite tape 14 and PTFE tape 16 is collected on takeup reel 38 after being pulled through tape wrapping machine 26 by capstan 40 at the desired speed. Alternatively, the wrapped conductor 2 will pass from second wrapping head 34 directly to the sintering ovens, discussed below.

The tension on the conductor and tapes must be set properly at the startup and adjusted when necessary. Conductor tension should be high enough to hold the conductor in place as it passes through the tape wrapping machine, but should be well below the break point of the conductor.

Tape film tension should be high enough to prevent wrinkles in the film as it is wrapped around the wire, and also high enough to prevent lifting of the exposed edge of the tape during the wrapping process. Tension should be increased if wrinkles or lifted edges appear. However, if the tension is too high there results a risk of breaking the tape. Besides the presence of wrinkles or lifted edges, the wrapping process providing too little tension may result in the formation of air pockets between the layers of tape which would result in bubbles or voids after the sealing step is completed. It has been found that the application of a 0.0015 inch (1.5 mil) composite tape 14 manufactured to a specified set of parameters (i.e. Chemfab lot No. 60-699-2) onto 20 19/32 AWG conductor within a tension range of 1000–1400 grams as measured by an in-line tension meter for a 15/64 inch wide tape with approximately 53% overlap, and of a 19/64 inch wide PTFE tape 16 manufactured with a specified PTFE resin and to a specified set of parameters with approximately 53% overlap within a tension range of 900–1000 grams produces an insulated conductor 2 having improved arc propagation resistance properties. Though optimum properties are obtained when both tapes 14 and 16 are applied with the above tension ranges respectively, improvement is noted even when only one tape is applied within the listed range. Differently processed tapes will have their own unique and optimum tension ranges. Additional background information on the wrapping of tape onto an electrical conductor is available in the du Pont KAPTON Technical Information Bulletin H-110-61, "Taping of Wire Insulated with KAPTON Polyimide Film", which is incorporated herein by reference.

The amount of tension on each tape used for wrapping the electrical conductor 4 has a substantial effect on the ability of the taped conductor to perform well in wet and dry arc-resistance testing. For example, if the composite tape 14 is applied too tightly, then its dry arc-resistance decreases dramatically. If the tension is too low, gaps within the tape after sealing can cause poor arc-resistance results as well as reduced mechanical and electrical properties of the finished insulated conductor 2 due to the tendency of the overlapped tape to separate. Further, if the outer PTFE tape 16 is wrapped too tightly, poor wet and dry arc propagation resistance and mechanical properties result.

In the manufacture of an insulated conductor 2, electrical conductor 4 was wrapped using a standard-type wrapping machine, such as can be purchased from United States Machinery, North Billerica, Mass., or E.J.R. Engineering and Machine Company Incorporated, Lowell, Mass.

The payoff tension from spool 20 feeding into tape wrapping machine 26 utilized a payoff device for providing a consistent and proper tension such as the mechanical drag type device with dancer feedback manufactured by Hesser Manufacturing, Model 1-7, or the electrical payoff device with dancer arm manufactured by Federal, Model PO-12. Other types of payoff devices such as the torque type or torque feedback type can also provide proper tension Various wire products were insulated in this type wrapping machine One such product was Part No. 19-32-601-21 from Hudson International Conductors, Ossining, N.Y., for nineteen strand copper strand of 32 AWG each plated with high purity tin.

The wrapping heads 32 and 34 were cage style heads It is expected, however, that other types of tape wrapping devices such as eccentric heads or devices which spin wire can be used to provide a satisfactory insulated conductor 2. Though it is most efficiently wrapped using a two-head tape wrapping machine 26, insulated conductor 2 has been produced using a single-head tape wrapping machine wherein the composite tape 14 and PTFE tape 16 were applied in separate operations. A diagram of this machine is provided as FIG. 4A. Slight performance differences may be observed for certain gauges of electrical conductor where the tape wrapping machine 26 is configured as a vertical or horizontal machine due to gravity effects. However, where a range of wire gauges are wrapped with tape on the same machine, the overall quality of the wrap for the two machine configurations is equivalent.

Figure 2:
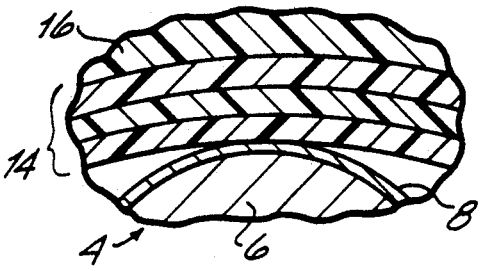
FIG. 2 is an enlarged view of the encircle section 2—2 of FIG. 1 showing the relationship of components in the first composite tape layer surrounding the electrical conductor.
Figure 3:
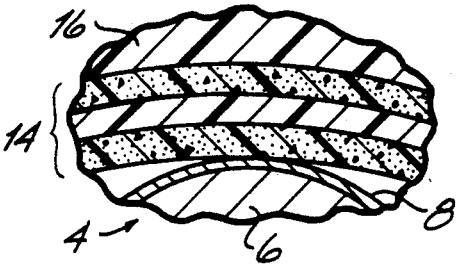
FIG. 3 is an enlarged view similar to FIG. 2 showing an alternative embodiment of the first composite layer surrounding the electrical conductor.

The composite tape 14 of the type shown in FIG. 2 can be obtained from Allied-Apical Company, Morristown, N.J. A 0.002 inch (2 mil) composite tape comprised of a 0.001 inch (1.0 mil) polyimide layer surrounded by two 0.0005 inch (0.5 mil) PTFE layers is available as Part No. 200AT919. A sealable composite tape as shown in FIG. 3 is available from Chemfab, Merrimack, N.H. A 0.002 inch (2 mil) tape comprised of a 0.001 inch (1.0 mil) polyimide layer surrounded by two 0.0005 inch (0.5 mil) PTFE layers is available as Part No. DF2919 (2.0). The sealable component in the Chemfab tape as shown in FIG. 3 is proprietary. Thus, it is not certain the distribution of this component in the PTFE layers of the composite tape 14. Therefore, the depiction in FIG. 3 is intended to show the presence of a sealable component with the PTFE layers, but not to define the method or type of distribution. The sealable component renders the PTFE in the composite tape 14 bondable at temperatures in the range of 600° to 700° F. Pure PTFE does not bond to itself readily. PTFE without a sealable component can bond to itself in an overlap tape configuration, but very high pressures and adequate temperatures are required. The unsintered PTFE tape 16 is available from several manufacturers such as Garlock, Inc., Plastomer Products, Newtown, Pa.

The degree of overlap of either composite tape 14 or PTFE tape 16 onto electrical conductor 4 is adjusted by varying the speed on the capstan 40 in FIG. 4. The capstan 40 is mechanically linked to the wrapping heads 32 and 34. By varying the ratio of the wrapping head speed to the capstan speed, the degree of overlap of each tape is modified. Alternatively, the capstan 40 can be operated without a mechanical link to the wrapping heads 32 and 34. What is required is that the ratio between the wrapping head speed and capstan speed is maintained to provide a constant and repetitive overlap. The takeup reel 38 is separately powered and employs an eddy current clutch to provide a steady torque on the wire as it exits the capstan 40. Adjustments are necessary to maintain a torque sufficient to provide enough tension to keep the wrapped electrical conductor 4 pulling at a steady speed from the capstan 40 without damaging the insulation.

Figure 4A:
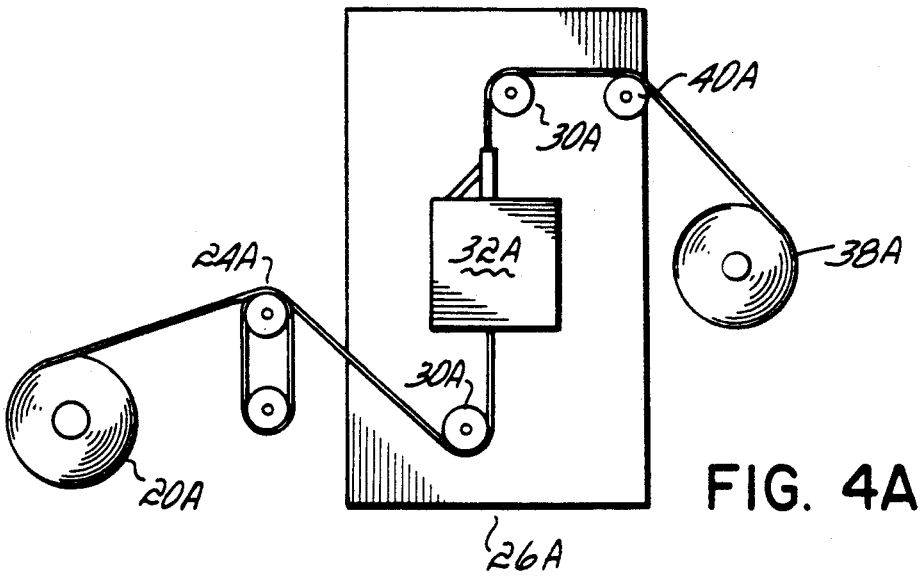
FIG. 4A is a diagramatic view of the apparatus used for applying a single layer of tape to an electrical conductor.

During the actual wrapping operation of a 20 gauge copper strand using a single head wrapping machine 26A as shown in FIG. 4A, payoff tension on electrical conductor 4 from spool 20A, through dancer 24A and under idler wheel 30A, was measured at a consistent 450–550 grams using a Tensitron TR-4000 in-line hand held tension meter. The electrical conductor 4 was produced by Hudson International Conductors and was composed of 19 strands of 32 AWG each tin plated wire configured in a unilay fashion. The wrapping head 32A was rotated at 1300 RPM and the capstan 40A pulled the wire at 28.25 feet per minute to achieve an overlap of 52 to 53 percent. The head direction for head 32A was clockwise facing the direction of the spool 20A. Counter-clockwise wrapping will provide equivalent results with the necessary equipment modifications.

A 0.002 inch (2.0 mil) composite tape was applied with an inline tension of 2100 to 2400 grams or a differential from the electrical conductor 4 tension of 1650 to 1850 grams. The actual tape tension, as opposed to the inline tension, was calculated to be 1900 to 2400 grams based on the tension measured by the inline meter divided by the cosine of the tape angle, which in this instance was 30°. The takeup reel 38A was set to run at 1000 to 1100 grams of tension The second tape, a 2.0 mil unsintered PTFE tape, was applied with an in-line tension differential of 700 grams. The actual tape tension, as opposed to the in-line tension, was calculated to be 780 grams based on the tension measured by the in-line meter divided by the cosine of the tape angle, which in this instance was 26.3. To achieve this 52–53% overlap, and tape angle of 26.3°, the wrapping head 32A was rotated at 650 RPM and the capstan 40A pulled the wire at 30 fpm. The head direction of head 32A was set counter-clockwise to cross-lap the PTFE tape 16 over the composite tape 14.

After the electrical conductor 4 was wrapped in tape wrapping machine 26A and retained on takeup reel 38A, the wrapped conductor was then heated to sintering temperature to cure the PTFE tape 16. Where the composite tape 14 included the sealable component discussed above, the temperature necessary for sintering was sufficient to seal the PTFE overlap layers of the composite tape to each other, thereby improving the sealing of the insulation.

Figure 5:
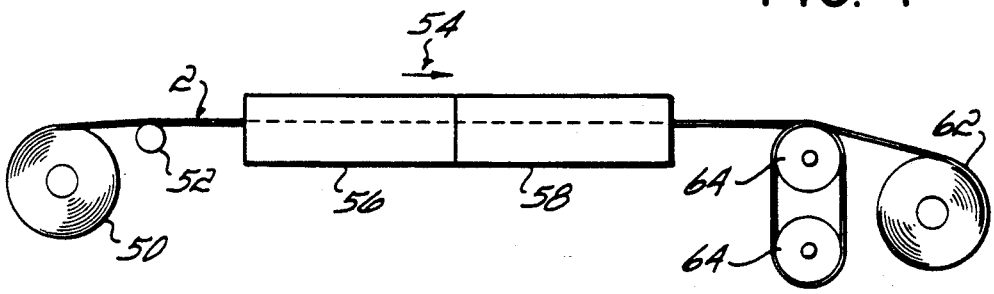
FIG. 5 is a diagramatic of the oven used to heat the insulated conductor to a sintering temperature.
Figure 6:
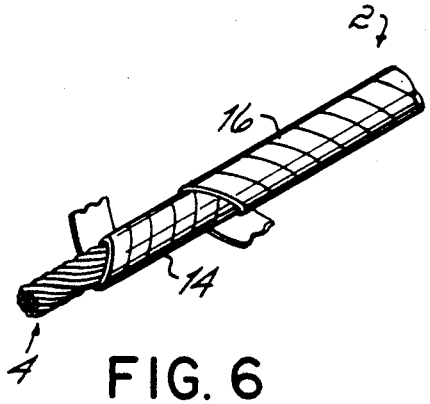
FIG. 6 is a perspective view of the insulated conductor with partial removal of the tape layers.

Sintering was accomplished by passing the wrapped electrical conductor through a series of ovens. Referring to FIG. 5, the oven payout spool 50 having the electrical conductor 4 wrapped with both composite tape 14 and unsintered PTFE tape 16 was passed over an idler wheel 52 and into an oven 54. An oven providing heat by convection may be constructed with Calrod heaters which are positioned either on both sides of the area through which the wrapped electrical conductor 4 is drawn, or as a spiral of one to five inch diameter. In either case, heating was by convection. Alternatively, the heating elements consist of wire embedded in a high temperature ceramic or wire wrapped around a quartz liner. Representative ovens are manufactured by Blue M, Blue Island, Ill., and Glenro, Inc., Paterson, N.J. Heat may also be applied by conduction, such as by contacting the insulation with a hot roller or a high temperature bath. Though not preferred, heat may also be supplied by induction, which sinters the PTFE from the inside out. However, where the conductor is tin plated, this method of heating tends to increase the risk of degradation.

The oven 54 is broken into a first zone 56 and a second zone 58. The diameter of the heated area inside first and second zones 56 and 58 through which the wrapped electrical conductor passes varies, but is typically several inches wide to permit several wires to pass through at one time. After heating, the sintered wrapped conductor was stored on takeup reel 62. Speed and tension control was maintained by passing the sintered wrapped conductor over capstan 64.

Sintering of 19 strand 32 gauge tin plated wire from Hudson International Conductors configured in the unilay fashion and wrapped with both Chemfab DF2919 2.0 mil composite tape and Garlock 2.0 mil unsintered PTFE tape was accomplished by paying off the wrapped electrical conductor 4 from the oven payout spool 50, over idler wheel 52 and into the first zone 56, which is heated to provide a temperature of 700° F. at the heating element. The length of first zone 56 was 42 inches. The wire after passing through first zone 56 entered second zone 58 which was set at a temperature of 1300° F. The length of the second zone 58 was also 42 inches. The zones were separated by a gap of five inches due to the inability to butt the oven zones end to end. This gap had no adverse effect on the sintering process, but larger gaps may result in excessive heat loss and result in modification of the sintering process. To achieve the necessary sintering without damaging the tin plating, this particular gauge wire was run through the oven 54 at a speed of 31.5 feet per minute. This speed varies with the wire size. Larger gauge wire, i.e. larger diameter, may be passed through the oven 54 at a slower speed without degrading the tin plate. From the oven 54, the sintered wrapped conductor passed over capstan 64 and ultimately onto takeup reel 62. At the time the insulated conductor 2 reached the takeup reel 62, the temperature of insulated conductor 2 had cooled from greater than 720° F. to approximately 100° F.

The temperature required to sinter the outer PTFE tape 16 was greater than 720° F. Because the tin plating on the copper strand degrades at elevated temperatures, one would expect that to produce a sintered insulated conductor based on a tin plated copper strand, that the sintering temperature should be decreased to the minimum possible value. It has been found unexpectedly that by increasing the temperature, the outer PTFE 16 can be sintered without degrading the underlying tin plating on the electrical conductor 4.

The insulated conductor 2 can be produced for a variety of wire gauges utilizing a variety of thickness of composite tape 14 and PTFE tape 16. Copper strand having an effective gauge from about 30 to about 4/0 can be wrapped and sintered. Composite tape 14 can be employed over a thickness range of about 0.0007 inch (0.7 mil) up to about 0.005 inch (5 mil). The two PTFE layers in the composite tape can vary from about 0.0001 inch (0.1 mil) to about 0.001 inch (1.0 mil), and the polyimide layer can vary from about 0.0005 inch (0.5 inch) to about 0.003 inch (3 mil). The unsintered PTFE tape can be employed in thicknesses from about 0.001 inch (1 mil) to about 0.01 inch (10 mil).

With the approximately 50% overlap used for wrapping the electrical conductor 4, the insulation at any point will have two layers of composite tape 14 and two layers of PTFE tape 16. The overall thickness of the insulated conductor 2 and thus of the tapes 14 and 16, will depend on the desired properties of the insulation on the insulated conductor 2. PTFE is known to improve arc propagation resistant properties. Polyimide insulation provides a high dielectric value and has high cut-through resistance. Under the proper processing conditions, a thicker insulation improves the protection for electrical conductor 4. However, weight and thickness considerations for specific applications require a balancing to obtain minimum weight and thickness for the required protection.

To demonstrate the effect of tape wrapping tension on the arc propagation resistance properties, several tests comparing these variables were conducted. Testing was conducted on 20 19/32 AWG nickel-plated copper strand. Chemfab DF2919(1.5) composite tape, Lot No. 60-699-2, was used in forming the first layer, followed with Garlock 1.5 mil PTFE tape. The sintering oven was two zone, 3.5 feet per zone, with the first zone set at 900° F. and the second at 1400° F. Speed through the oven was 31 feet per minute. The table shows the relationship of the wrapping tension on the composite tape to arc propagation resistance, measured by the Boeing BMS 13-60 arc resistance test and shown as a percentage failure rate out of 45 wires tested from each sample.

TABLE I

| Sample | Tension (Composite Tape) | Dry Arc Results (1.5 ohm circuit resistance) |
|---|---|---|
| 1 | 1000–1350 g | 2.2% failed |
| 2 | 1150–1850 g | 20.0% failed |

The preferred tension range from Table I is based on 20 gauge conductor. The above lower tension range is acceptable for this conductor, but the preferred range may change for different gauge conductor. The range may also change if a composite tape is manufactured with a different process and/or with a different PTFE thickness and/or resin.

Table II shows the effect of heat history during sintering of the wrapped electrical conductor 4. Heating was provided in a two zone oven, the zones each being 3.5 feet long. The first zone was set at 400° F. and the second at 1450° F. 20 19/32 AWG tin plated copper strand was wrapped with 15/64 inch DF2919(1.5) Chemfab composite tape, Lot No. 60-699-2 at 1090 RPM, followed by 19/64 inch 1.5 mil thick Garlock PTFE tape at 675 RPM. The conductor tension was 477 to 545 grams, while the tension on the composite and PTFE tapes, respectively, were in the range of 500 to 568 grams, and 227 to 410 grams.

To adjust the heat history of the insulation, the wrapped conductor samples were drawn through the two zones at different speeds. The heat history was a function of the average temperature of zones times the residence time, and quantified as degree-minutes. Thus the average temperature of the zones was (400° + 1450°) divided by 2 = 975° F. The total heating length was 7 feet. Wrapped conductor 4 was passed through the zones at speeds from 26 to 30 feet per minute, and the percentage of failures was determined using the Boeing BMS 13-60 arc propagation resistance test. At least 30 wires from each sample were tested and a percentage of failures calculated.

TABLE II

| Sample | Speed | Degree-Minutes $\left(975^\circ \text{ F.} \times \frac{7 \text{ ft.}}{\text{speed}}\right)$ | Dry Arc Results (1.5 ohm circuit resistance) |
|---|---|---|---|
| 3 | 26 fpm | 249 | 20% failed |
| 4 | 28 fpm | 231 | 8.9% failed |
| 5 | 30 fpm | 219.8 | 23.3% failed |

It can be seen that the zone temperatures, number of zones, and wire speed can be adjusted to produce comparable acceptable degree-minute values. However, these values, acceptable for 20 19/32 AWG tin-plated copper strand, may vary for other gauge wire. It has been calculated that failures can be maintained at or below 10% if the degree-minute value in the oven is in the range of about 228 degree-minutes to about 246 degree-minutes. For heating zones averaging about 925° F. at a seven foot length, the wire speed could vary from 26.3 fpm to 28.4 fpm (feet per minute).

The two layer tape construction of composite tape 14 and PTFE tape 16 discussed above provides excellent arc propagation resistance properties on a range of wire gauges. However, when the wire thickness reaches 8 gauge, the manner of forming the conductor by bundling groups of strands results in a rope strand appearance and creates a rougher surface which can cut into the adjacent tape layer during movement. As the conductor reaches gauge sizes 4 to 4/0, the stiffness and weight of the conductor increase the risk of damage to the outer tape layer by contact with hard surfaces during installation and use.

Figure 7:
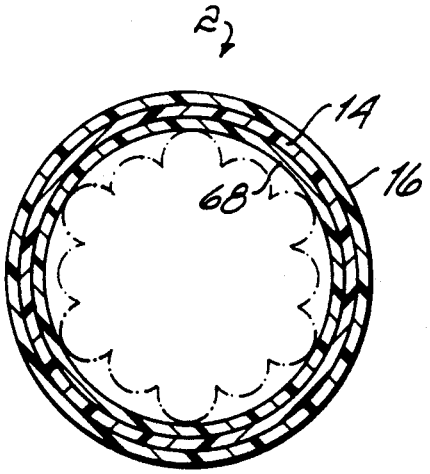
FIG. 7 is a cross-sectional view of the insulated conductor with heavier gauge electrical conductor.
Figure 8:
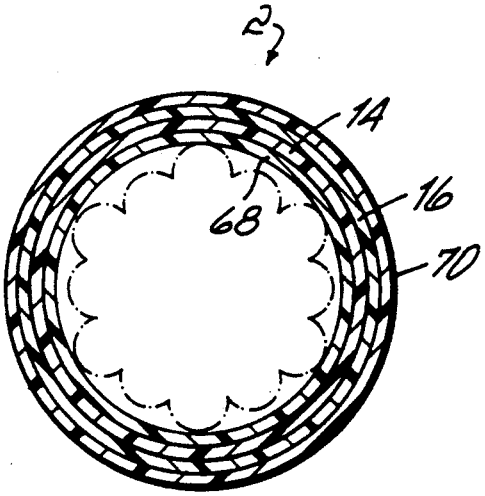
FIG. 8 is a cross-sectional view of the insulated conductor with still heavier gauge electrical conductor.

To address these mechanical stresses on the insulated conductor, a layer of skived PTFE of about 0.001 inch (1.0 mil) thickness is wrapped over the conductor prior to applying the composite tape 14, for 8 and 6 gauge conductor. For 4 gauge conductor and larger, the tape layer next to the conductor is skived PTFE of about 0.002 inch (2.0 mil) thickness, and an outermost layer is applied of unsintered PTFE of about 0.003 inch (3.0 mil) thickness. In all cases, the composite tape 14 and unsintered PTFE tape 16 are always adjacent. These constructions involving the additional layers of PTFE tape for added mechanical protection are shown in FIGS. 7 and 8, depicting skived PTFE tape 68 layer and the outermost PTFE tap 70 layer in relation to layers made from composite tape 14 and PTFE tape 16. The insulation layers surround a conductor of varying large gauge, depicted in phantom.

Insulated conductors 2 wrapped with the tapes as described above and utilizing the sintering process described herein for tin-plated stranded copper wire produced insulated conductor 2 having improved dry and wet arc propagation resistance properties together with weight and diameter characteristics which are required in the aircraft industry.

Thus it is apparent that there has been provided, in accordance with the invention, an insulated conductor and method of manufacture that fully satisfies the objects, aims, and advantages set forth above. While the invention has been described in conjunction with specific embodiment thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An insulated electrical conductor having arc propagation resistant properties comprising:

a conductor of electrical current;

a first film overlaying said conductor, said first film comprised of a composite of a polyimide layer between two layers of polytetrafluoroethylene; and a second film overlaying said first film, said second film comprised of unsintered polytetrafluoroethylene.

2. The insulated conductor of claim 1 wherein both said first and second films are formed from overlapping tape.

3. The insulated conductor of claim 2 wherein said first tape film is formed with an overlap of at least about 50%.

4. The insulated conductor of claim 2 wherein said first film is a 0.001 inch layer of polyimide between 0.0005 inch thick layers of polytetrafluoroethylene.

5. The insulated conductor of claim 2 wherein said polyimide layer of said first film has a thickness in the range of about 0.0005 to about 0.003 inch.

6. The insulated conductor of claim 2 wherein said polytetrafluoroethylene of said second film has a thickness in the range of about 0.001 to about 0.010 inch.

7. The insulated conductor of claim 2 wherein said polytetrafluoroethylene layers of said first film each have a thickness in the range of about 0.0001 to about 0.001 inch.

8. The insulated conductor of claim 2 wherein said second film is 0.002 inch polytetrafluoroethylene.

9. An insulated conductor having arc propagation resistant properties comprising:

a conductor of electrical current;

a first film overlaying said conductor, said first film comprised of a composite of a polyimide layer between two layers of polytetrafluoroethylene, said polytetrafluoroethylene layers including a sealable component; and a second film overlaying said first film, said second layer comprised of unsintered polytetrafluoroethylene.

10. An insulated conductor having arc propagation resistant properties, comprising:

a conductor of electrical current;

a first film overlaying said conductor, said first film comprised of a composite of a polyimide layer between two layers of polytetrafluoroethylene, said polytetrafluoroethylene layer including a sealable component; and a second film overlaying said first film, said second film comprised of unsintered polytetrafluoroethylene, further wherein said first and second films are heat treated at a temperature sufficient to activate said sealable component of said first film and to sinter said polytetrafluoroethylene of said second film.

11. The insulated conductor of claim 10 wherein said temperature is at least about 720° F.

12. A method of manufacturing an insulated conductor having arc propagation resistant properties, comprising:

applying to a conductor of electrical current having a tin plating a first overlapping tape film, said first tape film comprised of a composite of a polyimide layer between two layers of polytetrafluoroethylene;

applying over said first overlapping tape film a second overlapping tape film of sintered polytetrafluoroethylene; and heating said conductor covered with said first and second tape films to a temperature sufficient to sinter said polytetrafluoroethylene and insufficient to degrade said tin coating.

13. The method of claim 12, said heating at a temperature of at least about 720° F.

* * * * *

UNITED STATES PATENT AND TRADEMARK OFFICE

CERTIFICATE OF CORRECTION

PATENT NO. : 5,220,133

DATED : June 15, 1993

INVENTOR(S) : Jack E. Sutherland & Donald S. Dombrowsky

It is certified that error appears in the above-indentified patent and that said Letters Patent is hereby corrected as shown below:

Column 6, Line 40, a period is needed after the word "tension".

Column 6, Line 41, a period is needed after the word "machine".

Column 6, Line 46, a period is needed after the word "heads" (second occurrence).

Column 8, Line 1, "26.3" should be --26.3°--.

Column 11, Line 10, "tap" should be --tape--.

Column 12, Line 19, "layer" should be --film--.

Column 12, Line 52, "coating" should be --plating--.

Signed and Sealed this

Eleventh Day of October, 1994

*Attest:*

Bruce Lehman

BRUCE LEHMAN

*Attesting Officer*

*Commissioner of Patents and Trademarks*